United States Patent [19]

Orsini

[11] Patent Number: 4,974,610

[45] Date of Patent: Dec. 4, 1990

[54] PHOTOGRAPHIC IMPRINTING OF ARTIFICIAL FINGERNAILS

[76] Inventor: Yuko Orsini, 7830 E. David Dr., Tucson, Ariz. 85730

[21] Appl. No.: 383,817

[22] Filed: Jul. 21, 1989

[51] Int. Cl.[5] ..... A45D 29/00

[52] U.S. Cl. ..... 132/73; 132/285; 428/187; 156/242

[58] Field of Search ..... 132/73, 285; 428/187; 264/222, DIG. 30; 156/242, 245, 246

[56] References Cited

U.S. PATENT DOCUMENTS

| | | | |
|---|---|---|---|
| 2,544,408 | 5/1951 | Hile | 428/187 |
| 2,581,982 | 1/1952 | Terry | 132/73 |
| 2,816,555 | 12/1957 | Klump | 132/73 |
| 2,864,384 | 12/1958 | Walter | 132/73 |
| 3,300,358 | 1/1967 | Fournier | 428/187 |
| 3,736,946 | 6/1973 | Yando et al. | 132/73 |
| 3,969,175 | 7/1976 | Posner | 156/242 |
| 4,092,449 | 5/1978 | Bernstein | 428/29 |
| 4,093,489 | 6/1978 | Hong | 428/187 |
| 4,504,347 | 3/1985 | Munk et al. | 156/245 |
| 4,671,305 | 6/1987 | Mann | 132/73 |
| 4,718,957 | 1/1988 | Sensenbrenner | 132/73 |

FOREIGN PATENT DOCUMENTS

| | | | |
|---|---|---|---|
| 0288714 | 11/1988 | European Pat. Off. | 132/73 |
| 0831888 | 2/1952 | Fed. Rep. of Germany | 132/73 |
| 3337458 | 4/1985 | Fed. Rep. of Germany | 132/73 |
| 2241272 | 3/1975 | France | 132/73 |

*Primary Examiner*—John J. Wilson
*Assistant Examiner*—Frank A. LaViola, Jr.
*Attorney, Agent, or Firm*—Cahill, Sutton & Thomas

[57] ABSTRACT

A method for making sets of artificial fingernails wherein a single scene spans a set of 10 artificial fingernails. An image is photographically imprinted on a semi-rigid layer of photographic film. A layer of transparent plastic film is laminated over the layer of photographic film. The individual artificial fingernails are punched out of the layer of photographic film, and each is contoured by means of a heated press so that each artificial fingernail has a compound curvature wherein a proximal portion has a generally cylindrical curvature and a distal portion has a generally spherical curvature.

16 Claims, 1 Drawing Sheet

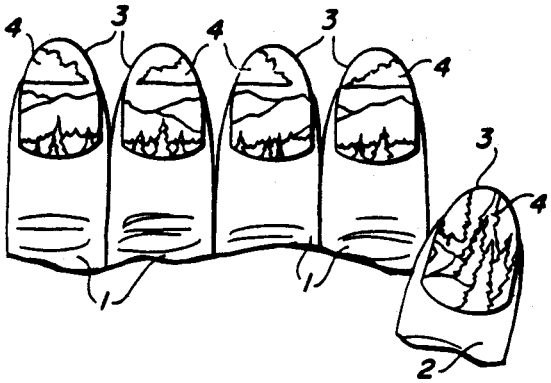
FIG. 1
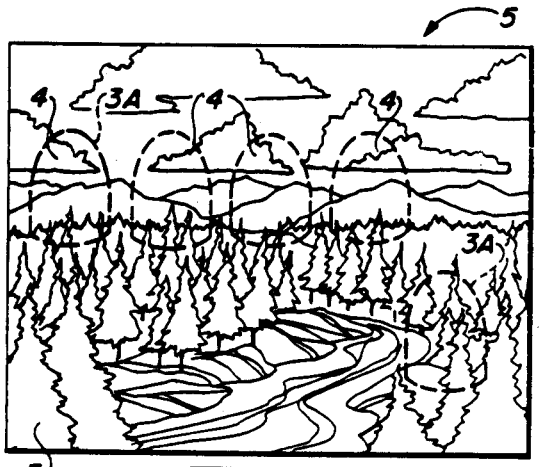
FIG. 2
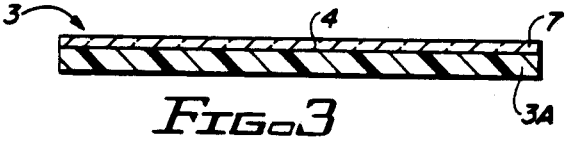
FIG. 3
FIG. 2A
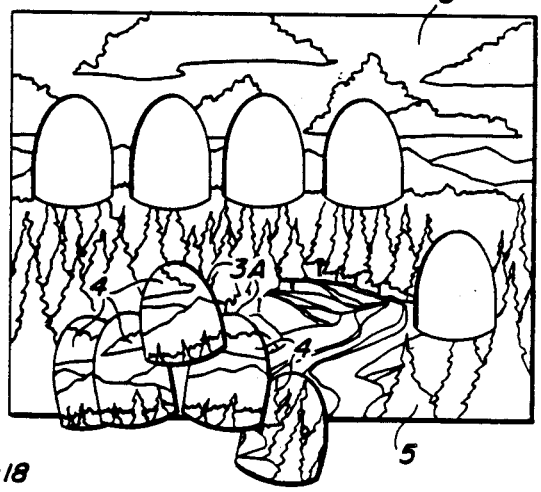
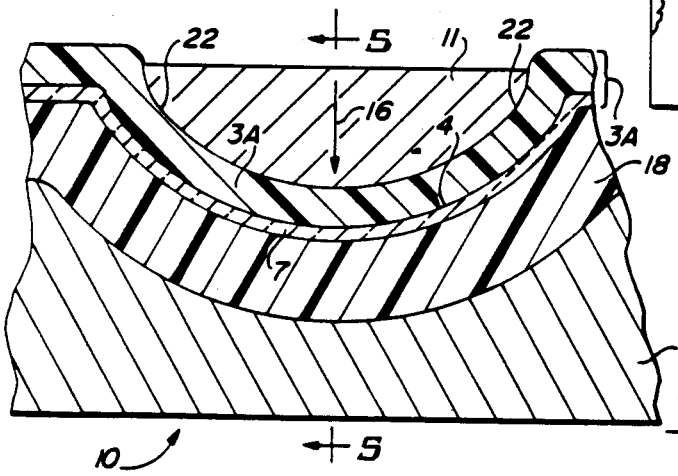
FIG. 2B
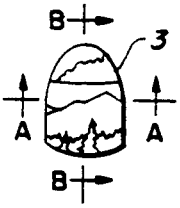
FIG. 4
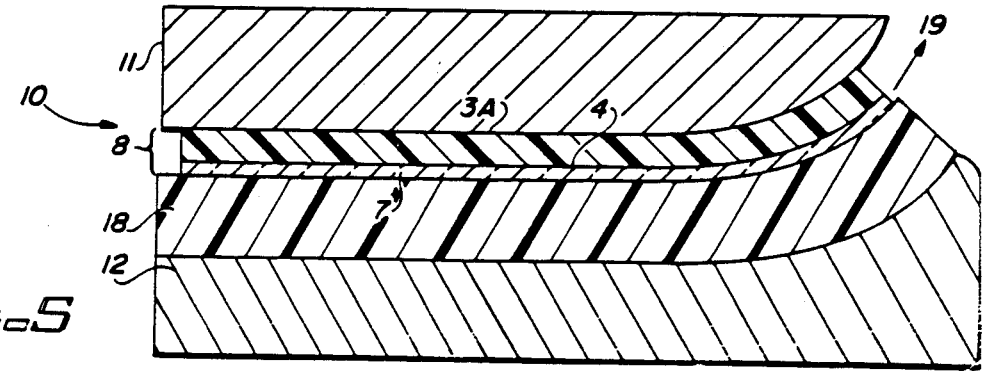
FIG. 5

PHOTOGRAPHIC IMPRINTING OF ARTIFICIAL FINGERNAILS

BACKGROUND OF THE INVENTION

The invention relates to a method and apparatus for making photographically imprinted artificial fingernails contoured to fit the curve of a natural fingernail.

Elaborately-designed fingernails have become very popular among women. Such designs can be created by "fingernail artists" who paint minute, intricate, multicolored designs on womens' natural fingernails. Sometimes a single design or scene spans an entire set of ten fingernails. However, it is quite time-consuming and expensive to handpaint a scene on a set of ten fingernails.

Less costly "designer fingernails" can be obtained by gluing artificial fingernails decorated with simple colors and designs onto natural fingernails. In general, such artificial fingernails are flat, and assume a contour only when pressed on and glued to the natural fingernail. However, artificial fingernails adhere better to natural fingernails if the artificial fingernails are curved similar to the curve of a natural fingernail.

Thus, there is an unmet need for an economical artificial fingernail that presents an intricate, multi-color photographic design and is contoured to better fit on a natural fingernail.

SUMMARY OF THE INVENTION

It is an object of the present invention to provide a method for imprinting a group of artificial fingernails with intricate and aesthetically pleasing photographic images.

It is another object of the present invention to provide an inexpensive method for imprinting artificial fingernails with a photographic image.

It is another object of the present invention to provide a method for contouring photographically imprinted artificial fingernails to more effectively fit over and adhere to natural fingernails.

It is another object of the present invention to provide a set of contoured artificial fingernails having a single design spanning the entire set of fingernails.

Briefly described and in accordance with one embodiment of the invention, the invention provides a method for creating a photographic image on artificial fingernails. An image is imprinted on a fingernail-shaped area of a film of photographic material. A transparent plastic material is laminated over the imprinted area. The laminated imprinted area is contoured so that it will fit over the curve of a person's fingernail. A single design is spanned by the photographic images imprinted on a complete set of artificial fingernails. The described embodiments include an apparatus for making an artificial fingernail including a photographic image. Means are provided for photographically imprinting an image on a fingernail-shaped area of semi-rigid photographic film. A plastic film is laminated over the fingernail-shaped area. A curling press imparts a compound curvature to the fingernail-shaped area. The curling press includes an upper member having a convex curvature along its transverse and longitudinal axes. A heating element is attached to the upper member for imparting heat to the fingernail-shaped area. The curling press further includes a lower member having a concave curvature along its transverse and longitudinal axes. Means are provided for pressing the upper and lower members together so that when the fingernail-shaped area is inserted therebetween and heated, it acquires a compound curvature similar to the curvatures of the upper and lower members. A resilient heat sink is attached to the lower member to protect the imprinted area of the fingernail-shaped area against excessive heat buildup. In a described embodiment of the invention, a single relatively large image is imprinted on the surface of the film, extending over a plurality of fingernail-shaped areas. The plastic film is laminated over all of the fingernail-shaped areas. The curling press produces the compound curvature in all of the fingernail-shaped areas, and then the fingernail-shaped areas are punched out of the film to form the imprinted artificial fingernails.

BRIEF DESCRIPTION OF THE DRAWINGS

FIG. 1 is a plan view of photographically imprinted artificial fingernails of the present invention attached to natural fingernails.

FIG. 2 is a plan view of fingernail-shaped areas outlined on photographic material.

FIG. 2A is a plan view of the outlined fingernail-shaped areas of FIG. 2 cut out of the photographic material.

FIG. 2B is a plan view of an artificial fingernail of the invention and is useful in describing the compound curvature thereof.

FIG. 3 is a cross-sectional view of a transparent plastic layer laminated over a fingernail-shaped area as shown in FIG. 2A.

FIG. 4 is a cross-sectional view of an artificial fingernail in a curling press.

FIG. 5 is a sectional view taken on line 5—5 of FIG. 4.

DETAILED DESCRIPTION OF THE PREFERRED EMBODIMENTS

FIG. 1 illustrates a set of artificial fingernails 3 bearing imprinted photographic images 4 attached to natural fingernails on the surfaces of a person's fingers 1 and thumb 2. A single scene spans the entire set of artificial fingernails 3. FIGS. 2, 2A, 3, 4, and 5 describe a method for making the set of artificial fingernails 3.

As shown by dotted lines in FIG. 2, fingernail-shaped areas 3A first are outlined on DURAFLEX 4023 estar base photographic film 5, manufactured by KODAK. This material is 9 mils thick. (DURATRANS photographic film man by KODAK also can be used. DURATRANS material is estar based photographic film, and is 7 mils thick. Also, FUJI HR photographic film can be used.) An entire scene 4 then is photographically imprinted on the film 5, covering the fingernail-shaped areas 3A. Preferably, a single scene or picture is "spanned" by the set of four fingernails and thumb areas 3A.

After the photographic image is imprinted, a transparent plastic layer 7 approximately 3 mils thick is laminated onto the imprinted surface of film 5. Layer 7 allows clear viewing of images 4 while protecting them against damage from abrasion or moisture.

As illustrated in FIG. 4, the sheet 5 containing the flat, laminated, imprinted artificial fingernail-shaped areas 3A then is inserted into a suitable curling press 10 to impart to each of the laminated imprinted areas 3A a contour similar to the curve of a natural fingernail. Curling press 10 has a plurality of an upper members 11

(only one of which is shown) and a plurality of corresponding lower members 12 used to apply pressure downward in the direction of arrow 16 to fingernail 3. A heating element (not shown) is included in upper member 11. A resilient heat sink layer 18 composed of approximately ¼ inch thick silicone rubber, is attached to lower member 12 to protect plastic layer 7 against excessive heat buildup.

Artificial fingernail area 3A can be most effectively and permanently contoured by heating it to a temperature in the range from approximately 175° F. to 188° F. for approximately 30 to 45 seconds while a pressure of approximately 35 pounds per square inch is being applied thereto by curling press 10. A temperature in excess of 188° F. may damage plastic layer 7.

Curling press 10 imparts compound curvature which corresponds to the curve of a natural fingernail. FIG. 2B shows a traverse axis A—A and a longitudinal axis B—B of a fingernail area 3A. The compound curvature along axis A—A has the shape shown in FIG. 4, wherein the end sections 22 are nearly vertical as shown. The radius of curvature of the portion of fingernail-shaped area 3A is less than for the fingernail to which it is to be attached, and the circumference of the fingernail-shaped area is slightly greater along section line A—A of FIG. 2B than that of the natural fingernail to which fingernail-shaped area eventually is to be attached, so that the edge portions 22 can be pushed neatly into the cuticle of the finger, resulting in a more natural appearance. The compound curvature along axis B—B has the shape shown in FIG. 5, wherein the rounded tip is curved convexly with respect to its outer laminated surface. Thus, the curvature along the proximal portion of fingernail area 3A is generally cylindrical, and the curvature of the distal portion of fingernail area 3A is generally spherical.

After the fingernail-shaped areas 3A have been molded by press 10, they are cut out of material 5, as illustrated in FIG. 2A. At this point, each of the imprinted, laminated, cut-out fingernails 3 has the compound curvature indicated in the transverse and longitudinal cross-sectional views of FIGS. 4 and 5, and a "connected" image appears on them when they are arranged in order.

The artificial fingernails 3 can be attached to natural fingernails by any common fingernail adhesive. The curvature of artificial fingernails 3 ensures that they will closely fit and thereby better adhere to natural fingernails, and that the rounded tip portion will have a natural curvature.

While the invention has been described with reference to several particular embodiments thereof, those skilled in the art will be able to make the various modifications to the described embodiments of the invention without departing from the true spirit and scope of the invention.

We claim:

1. A method for making an artificial fingernail including a photographic image, comprising the steps of:

(a) photographically imprinting an image on a fingernail-shaped area of a piece of semi-rigid photographic film;

(b) laminating a transparent plastic film over the imprinted area; and (c) contouring the fingernail-shaped area so that it fits over a curve of a natural fingernail.

2. The method of claim 1 wherein a plurality of fingernailshaped areas in the film are spanned by the image, and wherein the step of contouring includes pressing each fingernail-shaped area between a corresponding upper member of a curling press and a corresponding lower member of the curling press.

3. The method of claim 2 including heating the fingernail-shaped area of the piece of photographic film during the step of pressing.

4. The method of claim 3 including heating the fingernail-shaped areas by means of a heating element in the curling press upper member such that the transparent plastic film is pressed against the lower members of the curling press.

5. The method of claim 4 including pressing the laminated surface of the fingernail-shaped areas of the piece of photographic film against a resilient heat sink to protect the laminated surface against excessive heat buildup.

6. The method of claim 3 including heating the fingernail-shaped areas of the piece of photographic film to a temperature of at least 175° F.

7. The method of claim 6 including heating the fingernail-shaped areas of the piece of photographic film for approximately 30 to 45 seconds.

8. The method of claim 6 including heating the fingernail-shaped areas to a temperature of less than 188° F.

9. The method of claim 1 wherein step (a) includes imprinting a scene that spans five fingernail-shaped areas of the piece of photographic film, and step (b) includes laminating an entire surface of the piece of photographic film.

10. The method of claim 1 wherein step (c) includes producing a compound curvature of the fingernail-shaped areas including a generally cylindrical curvature of a proximal portion of the fingernail-shaped area and a generally spherical distal portion of the fingernail-shaped area.

11. A method for making an artificial fingernail including a photographic image, comprising the steps of:

(a) photographically imprinting an image on a fingernail-shaped area of a piece of semi-rigid photographic film;

(b) contouring the fingernail-shaped area so that it fits over a curve of a natural fingernail.

12. A method for making an artificial fingernail including a photographic image, comprising the steps of:

(a) photographically imprinting an image on a fingernail-shaped area of a piece of semi-rigid photographic material; and (b) laminating a transparent plastic film over the imprinted area.

13. An artificial fingernail comprising, in combination, a semi-rigid layer of photographic film having an image photographically imprinted thereon, and a layer of transparent plastic laminated on the imprinted image, the film being contoured to fit over a curve of a natural fingernail.

14. The artificial fingernail of claim 13 wherein the film is contoured to have a compound curvature including a generally cylindrical curvature of a proximal portion of the artificial fingernail and a generally spherical curvature of a distal portion of the artificial fingernail.

15. Artificial fingernails produced by the steps of:

(a) photographically imprinting an image on a fingernail-shaped area of a piece of semi-rigid photographic film;

(b) laminating a transparent plastic film over the imprinted area; and (c) contouring the fingernail-shaped area so that it fits over a curve of a natural fingernail;

(d) punching the fingernail-shaped areas out of the film after step (c).

16. An apparatus for making an artificial fingernail including a photographic image from a fingernail-shaped area of semi-rigid photographic film, comprising in combination:

(a) means for photographically imprinting an image on the fingernail-shaped area;

(b) a transparent plastic film laminated on the fingernail-shaped area over the image; and (c) a curling press for imparting a compound curvature to the fingernail-shaped area, including i. an upper member having a longitudinal axis and a convex, generally cylindrical curvature along a proximal portion of its longitudinal axis and a convex, generally spherical curvature at a distal portion of the fingernail-shaped area, ii. a heating element attached to the upper member for supplying heat to the fingernail-shaped area, iii. a lower member having a concave curvature along its longitudinal axis, iv. means for pressing the upper and lower members together so that when the fingernail-shaped area is pressed therebetween and heated, it acquires a compound curvature similar to a curvatures of the upper and lower members, and v. a resilient heat sink layer attached to the lower member to protect the imprinted area of the fingernail-shaped area against excessive heat buildup.

* * * * *